US010916388B2

(12) United States Patent
Ogawa et al.

(10) Patent No.: US 10,916,388 B2
(45) Date of Patent: Feb. 9, 2021

(54) SWITCH DEVICE

(71) Applicants: KABUSHIKI KAISHA TOKAI RIKA DENKI SEISAKUSHO, Aichi (JP); TOYOTA JIDOSHA KABUSHIKI KAISHA, Aichi-Ken (JP)

(72) Inventors: Sho Ogawa, Aichi-ken (JP); Tomoyuki Funayama, Aichi-ken (JP); Yasuhisa Ohta, Aichi-ken (JP); Yuya Goto, Aichi-ken (JP); Naoyuki Takada, Aichi-ken (JP)

(73) Assignees: KABUSHIKI KAISHA TOKAI RIKA DENKI SEISAKUSHO, Aichi (JP); TOYOTA JIDOSHA KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 16/374,915

(22) Filed: Apr. 4, 2019

(65) Prior Publication Data

US 2019/0311865 A1 Oct. 10, 2019

(30) Foreign Application Priority Data

Apr. 5, 2018 (JP) ..... 2018-073273

(51) Int. Cl.
*H01H 13/06* (2006.01)
*H01H 13/14* (2006.01)
*H01H 13/82* (2006.01)

(52) U.S. Cl.
CPC ..... *H01H 13/06* (2013.01); *H01H 13/14* (2013.01); *H01H 13/82* (2013.01);
(Continued)

(58) Field of Classification Search
CPC ..... H01H 13/06; H01H 13/82; H01H 13/14; H01H 2213/014; H01H 2213/006; H01H 2205/002; H01H 2205/004
(Continued)

(56) References Cited

U.S. PATENT DOCUMENTS 5,874,700 A * 2/1999 Hochgesang ..... H01H 13/702 200/515
5,981,890 A * 11/1999 Chen ..... H01H 13/702 200/515
(Continued)

FOREIGN PATENT DOCUMENTS

JP 60-060842 U 4/1985
JP H08-115633 A 5/1996
(Continued)

OTHER PUBLICATIONS

Extended European Search Report issued in corresponding European Application No. 19166980.3 dated Aug. 23, 2019.
(Continued)

*Primary Examiner* — Edwin A. Leon
*Assistant Examiner* — Lheiren Mae A Caroc
(74) *Attorney, Agent, or Firm* — Roberts Calderon Safran & Cole P.C.

(57) ABSTRACT

A switch device includes a substrate provided with at least one first contact and including at least one through hole, and a contact rubber, being an elastic sheet covering the substrate, provided with a dome-shaped cavity configured to make a second contact portion including a second contact corresponding to the first contact elastically deformable to be capable of contacting to and separating from the first contact, a vent cavity portion provided corresponding to the through hole, and an air groove communicating with the
(Continued)

cavity and the vent cavity portion between the substrate and the elastic sheet. The air groove includes a non-linear path.

7 Claims, 2 Drawing Sheets

(52) U.S. Cl.
CPC . *H01H 2205/002* (2013.01); *H01H 2205/004* (2013.01); *H01H 2213/006* (2013.01); *H01H 2213/014* (2013.01)

(58) Field of Classification Search
USPC ..... 200/306
See application file for complete search history.

(56) References Cited

U.S. PATENT DOCUMENTS

| | | | | |
|---|---|---|---|---|
| 6,144,003 | A | 11/2000 | Kamishima | |
| 6,531,671 | B2 | 3/2003 | Yeh | |
| 7,473,860 | B2 * | 1/2009 | Sample | H01H 9/0214 200/302.1 |
| 8,552,322 | B2 | 10/2013 | Takai | |
| 2004/0163845 | A1 | 8/2004 | Lu et al. | |
| 2012/0160655 | A1 | 6/2012 | Takai | |
| 2015/0060245 | A1 | 3/2015 | Raupach et al. | |
| 2016/0099119 | A1 | 4/2016 | Miyoshi et al. | |

FOREIGN PATENT DOCUMENTS

| | | | |
|---|---|---|---|
| JP | 2001-076585 | A | 3/2001 |
| JP | 2001-351465 | A | 12/2001 |
| JP | 2005-158720 | A | 6/2005 |
| JP | 2008-300156 | A | 12/2008 |
| JP | 2010-040490 | A | 2/2010 |
| JP | 2012-142128 | A | 7/2012 |
| JP | 2017134985 | A | 8/2017 |

OTHER PUBLICATIONS

Office Action issued in the related U.S. Appl. No. 16/374,948 dated May 19, 2020.
Notice of Allowance issued in the related U.S. Appl. No. 16/374,948 dated Aug. 27, 2020.
Office Action issued in related U.S. Appl. No. 16/374,948 dated Dec. 3, 2020.

* cited by examiner

SWITCH DEVICE

BACKGROUND

Technical Field

The present invention relates to a switch device, and more particularly to a switch device having a structure for suppressing ingress of foreign matter.

Related Art

As an example of a switch device in the related art, there is a switch having a structure in which an inversion plate (a movable contact plate) formed by forming an elastic metal plate in a dome shape is mounted on a stationary switch contact of a switch substrate (for example, JP 2005-158720 A).

In the switch in the related art disclosed in JP 2005-158720 A, a flexible shield plate covering the movable contact plate is provided over the switch board. The shield plate is piercingly provided with an air vent hole that communicates with a space formed between the movable contact plate and the switch substrate and also communicates with the outside air.

Pressing the shield plate turns the switch to ON-state by the movable contact plate being inverted, causing the movable contact plate to contact the stationary contact plate. Releasing pressing of the shield plate automatically returns the movable contact plate to the original state by the resilient force, thus separates the movable contact plate from the stationary contact plate to bring the switch into OFF-state.

JP 2005-158720 A states that, in a structure in which a cover is provided by a shield plate over the switch board, a difficulty of the switch pressing operation due to the air inside the switch being compressed during the switch pressing operation can be reliably prevented.

SUMMARY

However, in this type of switch in the related art, since an air vent hole communicating with the space formed between the movable contact plate and the switch substrate is provided in the shield plate covering the movable contact plate, ingress of foreign matter such as dust or a water droplet may occur. In a case where foreign matter ingresses into and accumulates in this space, there is a possibility that a contact failure, a short circuit, or the like may occur between the movable contact plate and the stationary switch contact of the switch substrate, which is not preferable.

Thus, an object of the invention is to provide a switch device capable of suppressing ingress of foreign matter.

To achieve the purpose described above, a switch device according to an aspect of the invention including, a substrate provided with at least one first contact and including at least one through hole, and a contact rubber, being an elastic sheet covering the substrate, provided with a dome-shaped cavity configured to make a second contact portion including a second contact corresponding to the first contact elastically deformable to be capable of contacting to and separating from the first contact, a vent cavity portion provided corresponding to the through hole, and an air groove communicating with the cavity and the vent cavity portion between the substrate and the elastic sheet, wherein the air groove is a non-linear path.

Further, in the switch device according to an aspect of the invention, the contact rubber includes at least two cavities of the second contact portions corresponding to the first contact, and the cavities communicate with one another via one air groove between the substrate and the elastic sheet.

Further, in the switch device according to an aspect of the invention, the air groove communicating with the plurality of cavities is a non-linear path.

The switch device according to an aspect of the invention further including, a cover member disposed facing to the back surface of the substrate, wherein a gap between a surface of the cover member facing the through hole and the substrate is set to be smaller than a foreign matter of a prescribed size.

Advantageous Effect of the Invention

According to an aspect of the invention, a switch device capable of suppressing ingress of foreign matter such as dust and water droplets may be provided.

DESCRIPTION OF EMBODIMENTS

A switch device according to embodiments will be described below with reference to the accompanying drawings.

Overall Configuration of a Switch Device Embodiments to be described below can be applied to switch devices of various devices such as vehicle-mounted device such as air conditioners and door mirrors, remote operation devices such as personal computers and mobile phones, home electrical devices such as refrigerators and washing machines.

Figure 1A:
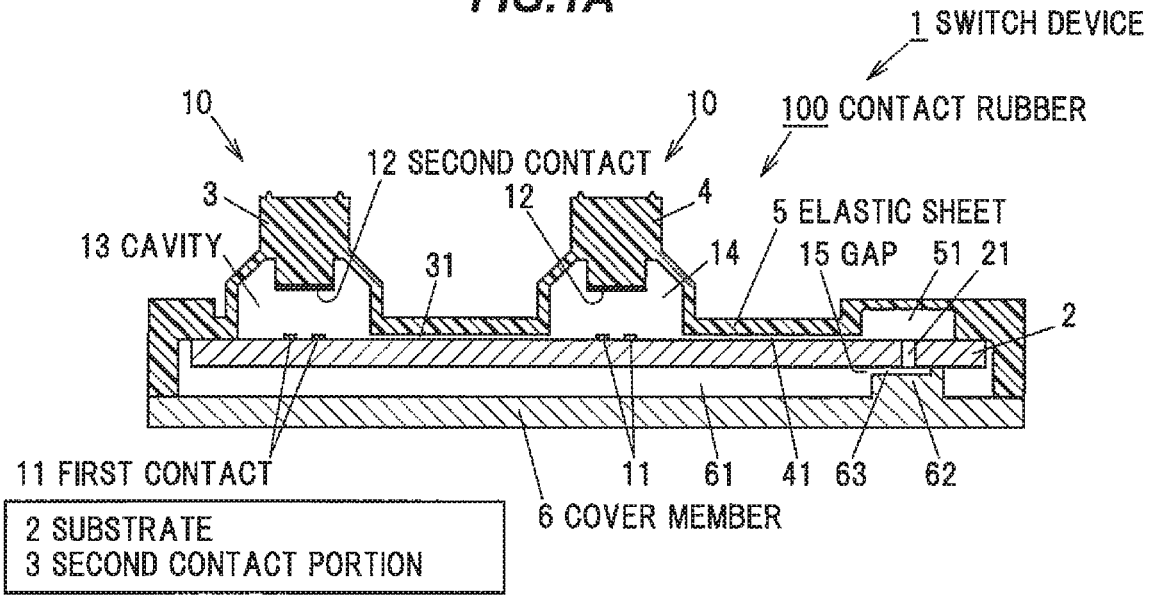
FIG. 1A is a cross-sectional view schematically illustrating an example of a main component of a switch device according to an embodiment of the invention.

In FIG. 1A, the switch device 1 includes two switch portions, which are a first switch portion 10 and a second switch portion 10, configured to perform a switch operation in response to a pressing operation of an operation member. Each of the switch portions 10 is constituted by, two first contacts 11 and 11 electrically connected to the wiring of the substrate 2, and an elastically deformable and dome-shaped first or second second contact portion 3 and 4 including a second contact 12 capable of contacting to and separating from the first contacts 11, and has substantially the same structure.

Figure 1B:
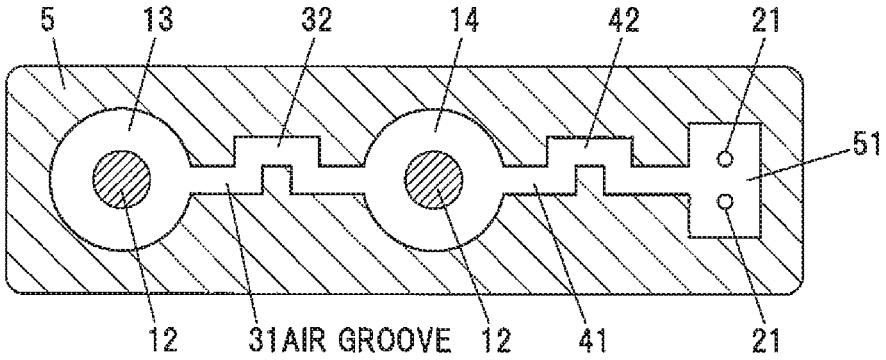
FIG. 1B is a cross-sectional plan view of a main component for explaining an example of the internal structure of the switch device according to the embodiment.

As illustrated in FIG. 1A and FIG. 1B, each of the first and second second contact portions 3 and 4 is formed as a dome-shaped cavity at a portion corresponding to the first contacts 11 in one elastic sheet 5 covering the substrate 2. A second contact 12 is provided on each of the internal bottom face forming the cavity 13 of the first second contact portion 3 and the internal bottom face forming the cavity 14 of the second second contact portion 4. A cover member 6 is disposed facing to the back surface of the substrate 2, and the elastic sheet 5 is fixedly supported by the cover member 6.

Figure 1C:
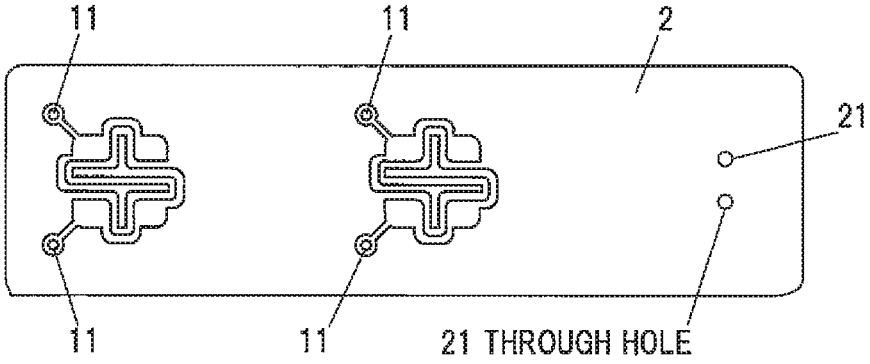
FIG. 1C is a plan view for explaining an example of a substrate used in the switch device according to the embodiment.

As illustrated in FIG. 1C, the first contact 11 has a pattern in which a meandering conductor, a bent conductor, and a branched conductor are continuous on the substrate 2, with the two first contacts 11 and 11 formed in a comb teeth shape engaged with each other. With such a configuration, even when the second contact 12 deviates from the first contact 11 during the pressing operation of the second contact portions 3 and 4, the allowable range of the contact deviation can be expanded, enabling a conduction failure and the like between the first contact 11 and the second contact 12 to be alleviated.

The first contact 11 and the second contact 12 are made of metal materials having conductive properties such as copper or silver. The substrate 2 is made of an insulating rigid plate, and the elastic sheet 5 is made of a member having elasticity such as a rubber material or a soft resin material. In the illustrated example, a contact rubber formed of a silicone rubber is used for the elastic sheet 5 and the two second contact portions 3 and 4 which are dome-shaped cavities.

As described above, the contact rubber 100 is an elastic sheet 5 covering the substrate 2, and constituted by dome-shaped cavities 13 and 14 configured to make second contact portions 3 and 4 having a second contact 12 corresponding to the first contact 11 elastically deformable to be capable of contacting to and separating from the first contact 1, a vent cavity portion 51 provided corresponding to the through hole 21, and an air groove 41 communicating with the cavity 14 and the vent cavity portion 51 between the substrate 2 and the elastic sheet 5. In this embodiment, the contact rubber 100 includes at least two cavities of the second contact portions 3 and 4 corresponding to the first contact 11, and the cavities 3 and 4 communicate with one another via one air groove 31. As will be described later, the air groove 31 is a non-linear path.

Configuration of Mechanism to Suppress Ingress of Foreign Matter

As illustrated in FIGS. 1A and 1B, between the back surface of the elastic sheet 5 and the substrate 2, a first air groove 31 communicating with the cavity 13 of the first second contact portion 3 and the cavity 14 of the second second contact portion 4, and a second air groove 41 communicating with the cavity 14 of the second second contact portion 4 are formed. The second air groove 41 communicates with a vent cavity portion 51 recessingly formed and sunken in the back surface of the elastic sheet 5.

The first air groove 31 and the second air groove 41 are formed in a recessed groove shape sunken in the back surface of the elastic sheet 5. The first air groove 31 and the second air groove 41 are connected as one path groove. As a result, the air existing in the cavities 13 and 14 of the first and second second contact portions 3 and 4 can enter and exit.

It should be noted that the first air groove 31 and the second air groove 41 have such strength that the spatial shape of the air groove can be maintained to such an extent that air can pass through when the second contact portions 3 and 4 are pressed.

The first air groove 31 and the second air groove 41 are formed in nonlinear paths, the paths configured to be non-linearly curved, meandering, bent, or the like, such that ingress of foreign matter such as dust or water droplets from the vent cavity portion 51 into the cavities 13 and 14 of the second contact portions 3 and 4 is deterred.

In the illustrated example, the first air groove 31 has a bent path 32 bent in a crank shape in a middle portion between a straight path extending from the cavity 13 of the first second contact portion 3 and a straight path extending from the cavity 14 of the second second contact portion 4. The other of the air grooves, the second air groove 41 has a bent path 42 bent in a crank shape, similarly to the first air groove 31.

Two through holes 21 and 21 formed piercing the substrate 2 communicate with the vent cavity portion 51 that is in communication with the second air groove 41. The internal bottom face of the vent cavity portion 51 is configured larger than the internal bottom face of the second air groove 41. The through hole 21 communicates with the inner space 61 of the cover member 6 disposed facing to the substrate 2.

These through holes 21 are provided at positions corresponding to the vent cavity portions 51 and communicate with the air grooves 41. Being an independent through hole not electrically connected to the first contact 11 or the circuit of the substrate 2, and not inserted with electrical parts, leads, or the like mounted on the substrate, the through hole 21 serves as the entrance to let the air existing in the cavity 13 of the first second contact portion 3 and the cavity 14 of the second second contact portion 4 enter and exit when the second contact portions 3 and 4 are press-operated. By making the through hole electrically independent of the first contact 11 and the circuit of the substrate 2, even if water droplets or the like ingress into the through hole, the electric corrosion of the through hole portion, the short-circuit of circuits, and the like, can be suppressed.

Since it is also possible to form a through hole for connecting a mounted component mounted on the substrate 2 and the first contact 11, and the through hole 21 simultaneously, the mechanism to suppress ingress of foreign matter can be efficiently manufactured.

The gap 15 formed between the surface of the cover member 6 facing the through hole 21 of the substrate 2 and the back surface of the substrate 2 is set to a value smaller than the foreign matter of a prescribed size. This prescribed size is the size, for example, about 0.3 mm or less, capable of preventing ingress of dust, water droplets, or insects such as ants. This gap 15 is set to a size that suppresses ingress not only of foreign matter such as dust and water droplets but also insects such as ants.

In the illustrated example, the surface of the cover member 6 facing the through hole 21 of the substrate 2 is constituted by the top portion of the ridge portion 62 protruding from the bottom surface of the cover member 6. At the top portion of the ridge portion 62 is provided a vent recess 63 to let the air in the cavities 13 and 14 of the two second contact portions 3 and 4 enter and exit through the through hole 21. The gap 15 formed between the internal bottom face of the vent recess 63 and the back surface of the substrate 2 is set to a value smaller than a prescribed size foreign matter, for example, about 0.3 mm or less.

The entrance through which the air existing in the cavities 13 and 14 of the two second contact portions 3 and 4 flows out and in does not need to be constituted by the two through holes 21 but may be a single through hole. By providing two or more through holes 21, when one through hole becomes clogged, the air existing in the cavities 13 and 14 of each second contact portion 3 and 4 may flow out and in to/from the back surface side of the substrate 2 through another through hole which is not clogged.

Figure 2:
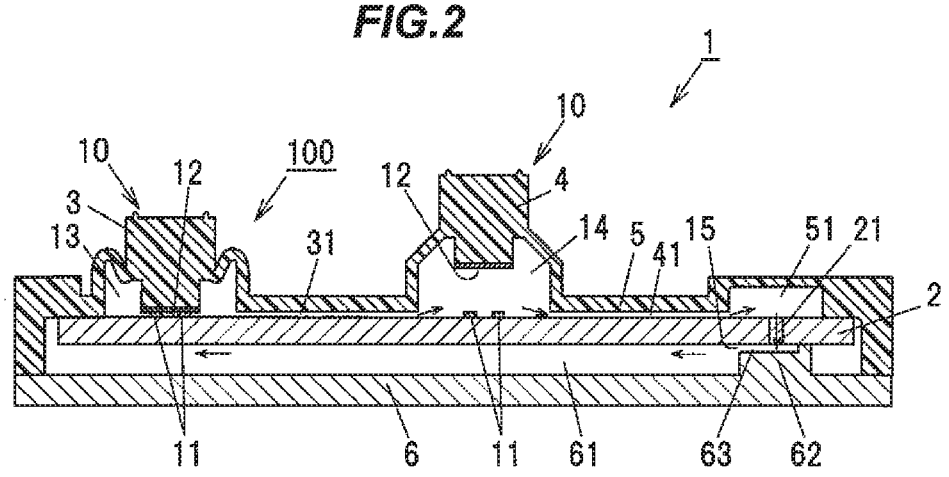
FIG. 2 is a cross-sectional view of a main component corresponding to FIG. 1A for explaining the flow of air inside the switch device according to the embodiment.

As illustrated in FIG. 2, when the first second contact portion 3 is press-operated, the second contact portion 3 is compressed and deformed by inverting operation. The lower surface of the second contact 12 of the second contact portion 3 comes into contact with the first contact 11 of the substrate 2, and the first contact 11 and the second contact 12 are brought into a switched ON-state.

At the time of the inverting operation of the second contact portion 3, the air existing in the cavities 13 and 14 of the second contact portion 3 and 4 can be released to the back surface side of the substrate 2 from one path groove constituted by the first air groove 31 and the second air groove 41, through the vent cavity portion 51 and the through hole 21.

On the other hand, when the pressing force of the first second contact portion 3 is released, the second contact portion 3 automatically returns to the original dome shape due to the elastic restoring force. The second contact 12 of the second contact portion 3 is separated from the first contact 11 of the substrate 2, and the first contact 11 and the second contact 12 are brought into a switched OFF-state.

Figure 3:
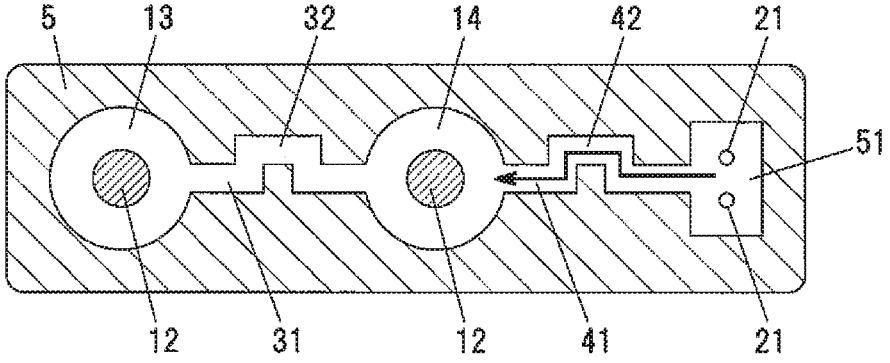
FIG. 3 is a cross-sectional plan view of a main component corresponding to FIG. 1B for explaining the flow of air inside the switch device according to the embodiment.

When the second contact portion 3 automatically returns, as illustrated in FIG. 3, it has the effect of sucking in the air on the back surface of the substrate 2 through the through hole 21, the vent cavity portion 51, the second air groove 41, and the first air groove 31, guiding the air into the cavities 13 and 14 of the second contact portions 3 and 4.

Effect of Embodiments

According to the switch device 1 having the above-described configuration, the following effects can be achieved in addition to the above-described effects.

Since the first air groove 31 and the second air groove 41 form a nonlinear path rather than a straight line path that connects one straight line, even if foreign matter such as dust, water droplets, or the like exists in the vent cavity 51, ingress of foreign matter from the inside of the vent cavity portion 51 into the cavities 13 and 14 of the second contact portions 3 and 4 at the time the second contact portions 3 and 4 are press-operated, is deterred, suppressing conduction failure and the like between the second contact 12 and the first contact 11.

Since the first air groove 31 communicating with the cavity 14 of the second contact portion 3 and the second air groove 41 communicating with the cavity 14 of the second contact portion 4 are formed as one path groove, it enables the possibility that failures such as contact failures occurring at the first second contact portion 3 and the second second contact portion 4 at the same time to be reduced.

In addition to the first air groove 31 and the second air groove 41 forming a nonlinear path, configuring the gap 15 formed between the surface of the cover member 6 facing the through hole 21 of the substrate 2 and the back surface of the substrate 2 to about 0.3 mm or less enables ingress of foreign matter such as not only dust and water droplets but also insects such as ants to be reduced.

In the above embodiment, a switch device 1 is exemplified which is constituted by two sets of the switch portions 10, which are, respectively a set of the first contact 11 and the first second contact portion 3, and a set of the first contact 11 and the second second contact portion 3. Here, the switch device may be a switch device configured to switch two or more switch portions 10 simultaneously, or a switch device configured to switch either of the two or more switch portions 10 individually.

In addition, the switch device does not need to be constituted by two or more switch portions 10, and may of course be constituted by a single switch portion 10.

As is apparent from the above description, the representative embodiments, modifications, and illustrated examples according to the invention have been exemplified, but the above-mentioned embodiments, modifications, and illustrated examples do not limit the scope of the patent claims and can be implemented in various aspects without departing from the gist thereof. As such, it should be understood that all combinations of the features described in the embodiments, modifications, and illustrated examples are not required parts of the means to solve the problems of the invention.

REFERENCE SIGNS LIST

1 Switch device
2 Substrate
3, 4 Second contact portion
5 Elastic sheet
6 Cover member
10 Switch portion
11 First contact
12 Second contact
13, 14 Cavity
15 Gap
21 Through hole
31, 41 Air groove
32, 42 Bent path
51 Vent cavity portion
61 Inner space
62 Ridge portion
63 Vent recess
100 Contact rubber

The invention claimed is:

1. A switch device, comprising:

a substrate provided with at least one first contact and including at least one through hole; and a contact rubber, being an elastic sheet covering the substrate, provided with a dome-shaped cavity configured to make a second contact portion including a second contact corresponding to the first contact elastically deformable to be capable of contacting to and separating from the first contact, a vent cavity portion provided corresponding to the through hole, and an air groove communicating with the cavity and the vent cavity portion between the substrate and the elastic sheet, wherein the air groove comprises a non-linear path, wherein the vent cavity portion the cavity are on a same side of the substrate, and wherein the through hole pierces the substrate so as to allow air to flow therethrough, and wherein the cavity portion is larger than the air groove in a thickness direction of the switch device.

2. The switch device according to claim 1, wherein the contact rubber comprises at least two cavities of the second contact portion corresponding to the first contact, and the cavities communicate with one another via one air groove between the substrate and the elastic sheet.

3. The switch device according to claim 2, wherein an air groove connecting adjacent ones of the at least two cavities comprises a non-linear path.

4. The switch device according to claim 1, further comprising a cover member disposed facing to a back surface of the substrate, wherein a gap between a surface of the cover member facing the through hole and the substrate is set to be smaller than a foreign matter of a prescribed size.

5. The switch device according to claim 1, wherein the through hole is electrically independent of a circuit on the substrate.

6. The switch device according to claim 1, wherein the vent cavity portion has none of the first contact and the second contact.

7. The switch device according to claim 1, wherein the contact rubber comprises at least two cavities, wherein the at least two cavities and the vent cavity portion adjacent to an end of the at least two cavities form a single air groove, and wherein the single air groove is terminated at a farthest one of the at least two cavities from the vent cavity portion.

* * * * *